US009714567B2

(12) United States Patent
Godager et al.

(10) Patent No.: US 9,714,567 B2
(45) Date of Patent: Jul. 25, 2017

(54) WELLBORE E-FIELD WIRELESS COMMUNICATION SYSTEM

(71) Applicant: SENSOR DEVELOPMENTS AS, Sandefjord (NO)

(72) Inventors: Øivind Godager, Sandefjord (NO); Fan-Nian Kong, Oslo (NO)

(73) Assignee: Sensor Development AS, Sandefjord (NO)

( * ) Notice: Subject to any disclaimer, the term of this patent is extended or adjusted under 35 U.S.C. 154(b) by 720 days.

(21) Appl. No.: 14/105,113

(22) Filed: Dec. 12, 2013

(65) Prior Publication Data

US 2015/0167452 A1 Jun. 18, 2015

(51) Int. Cl.

| | |
|---|---|
| ***E21B 47/12*** | (2012.01) |
| ***H01Q 9/16*** | (2006.01) |
| ***H01Q 1/04*** | (2006.01) |

(52) U.S. Cl.

CPC ..... *E21B 47/122* (2013.01); *H01Q 1/04* (2013.01); *H01Q 9/16* (2013.01)

(58) Field of Classification Search

CPC ..... E21B 47/122; E21B 47/12; H01Q 9/16; H01Q 1/04

See application file for complete search history.

(56) References Cited

U.S. PATENT DOCUMENTS

| | | | | |
|---|---|---|---|---|
| 4,057,781 | A * | 11/1977 | Scherbatskoy | E21B 47/122 340/854.4 |
| 4,806,928 | A | 2/1989 | Veneruso | |
| 4,839,644 | A | 6/1989 | Safinya et al. | |
| 5,008,664 | A | 4/1991 | More et al. | |
| 6,070,662 | A * | 6/2000 | Ciglenec | E21B 7/061 166/113 |
| 7,256,706 | B2 * | 8/2007 | Haase | E21B 47/12 166/313 |
| 7,878,249 | B2 | 2/2011 | Lovell | |
| 2002/0195247 | A1 | 12/2002 | Ciglenec et al. | |
| 2011/0011580 | A1 | 1/2011 | Clark et al. | |
| 2011/0030946 | A1 | 2/2011 | Upshall | |
| 2013/0168081 | A1 | 7/2013 | Yang et al. | |

FOREIGN PATENT DOCUMENTS

| | | | |
|---|---|---|---|
| EP | 0295178 | A2 | 12/1988 |
| EP | 0678880 | A1 | 10/1995 |
| WO | 01/18358 | A1 | 3/2001 |
| WO | 2009/151444 | A1 | 12/2009 |

OTHER PUBLICATIONS

PCT International Search Report dated May 8, 2015, for International Application No. PCT/NO2014/050229.

* cited by examiner

*Primary Examiner* — G. M. Hyder
(74) *Attorney, Agent, or Firm* — Haynes and Boone, LLP

(57) ABSTRACT

A wellbore E-field wireless communication system, the communication system comprising a first E-field antenna, and a second E-field antenna, wherein the first antenna, and the second antenna are both arranged in a common compartment, such as an annulus of a wellbore and further arranged for transferring a signal between a first connector of the first E-field antenna and a second connector of the second E-field antenna by radio waves.

10 Claims, 8 Drawing Sheets

WELLBORE E-FIELD WIRELESS COMMUNICATION SYSTEM

BACKGROUND OF THE INVENTION

Field of the Invention

The present invention relates to the technical field of establishing communication links between surface or land-based equipment and instrumentation arranged in a wellbore. More specifically the invention relates to wireless communication in an annulus of the wellbore, where the annulus may extend into one or more lateral wellbores.

Description of the Related Art

Wireless downhole sensor technology is being deployed in numerous oil and gas wells. In prior art, system components are inductively coupled, which enables remote placement of autonomous apparatus in the wellbore without the need to for any cable connection, cord or battery to neither power nor communicate. These systems make use of a pair of inductive coils where one of the coils usually is casing conveyed, i.e. arranged in the wellbore as part of the casing or liner program, and the other coil is tubing conveyed, which means that it is inserted into the wellbore as part of the completion program. Thus, the pair of coils have to be aligned, usually as part of the completion program, so that they are within a certain distance required for the magnetic field from one coil to be detected by the other coil and vice-versa.

The inductive coils typically consist of a conductor wound around a core. On the sender side a magnetic field will be generated when an electric current is applied to the conductor, while on the receiver side a voltage across the conductor coil will be generated when the magnetic field from the sender attracts the receiver coil. We may say that the receiver coil is harvesting from the sender.

In prior art, power harvesting has been used to provide power to the remote side of the inductive wireless link to power a remote wellbore instrument, so that the instrument has sufficient power to transmit data from the remote wellbore instrument, e.g. sensor data back to the tubing conveyed coil.

The tubing conveyed coil may in turn be connected to a surface control system aboard a platform or ship by a downhole cable, and the control system will eventually receive the information from the remote wellbore instrument so that it can be used to analyze the properties of the wellbore or the surrounding formation.

One problem related to the system of prior art is that the range of the inductive wireless link is limited, and that alignment of the inductive coils is critical for establishment of the link. This may slow down the progress to run and set a completion program for the wellbore due to the inherent need of proximity between the inductive couplers involved.

A further problem is related to the amount of information that can be carried over the inductive wireless link. Information or data is usually in digital form and modulated over the low frequency inductive field that works as a carrier.

U.S. Pat. No. 5,008,664 discloses an apparatus employing a set of inductive coils to transmit AC data and power signals between a downhole apparatus and apparatus of the surface of the earth.

European patent application EP 0678880 A1 discloses an inductive coupling device for coaxially arranged tubular members, where the members an be telescopically arranged and the liner member has a magnetic core assembly constructed from magnetic iron with cylinder sloped ends and the outer member has an annular magnetic assembly aligned with the core assembly.

U.S. Pat. No. 4,806,928 discloses a inner and outer coil assemblies arranged on ferrite cores arranged on a downhole tool with an electrical device and a suspension cable for coupling the electrical device to a surface equipment via the coil assemblies.

Of specific interest for this kind of communication systems, is the possibility for establishing communication with wellbore instruments in lateral wellbores. Lateral wellbores are important for improving production and exploit nearby occurrences of petroleum in the formation.

International patent publication WO2001198632 A1 and US patent application US2011011580 A1 discloses the use of inductive wireless links for establishing communication between a mother wellbore and lateral wellbores. However, in addition to the problems related to prior art above, a new problem related to arrangement of the inductive coils appears. Due to the nature of the lateral junctions, it is difficult to avoid that they become obstacles for the inductive wireless link, so that it becomes hard to establish a reliable communication.

SUMMARY OF THE INVENTION

A main object of the present invention is to disclose a method and a system for improving the signal transfer and energy efficiency of the signal and power transmission between wireless transmitters and receivers of wireless links inside the wellbore.

The invention is a wellbore E-field wireless communication system where the signal transfer and energy efficiency is improved compared to systems described in prior art.

The wellbore E-field wireless communication system comprises;

a first E-field antenna (11), and a second E-field antenna (21), wherein the first antenna (11), and the second antenna (21) are both arranged in a common compartment (210) of a wellbore (2) and further arranged for transferring a signal between a first connector of the first E-field antenna (11) and a second connector of the second E-field antenna (21) by electromagnetic radiation (Ec).

The first and second E-field antennas (11, 21) are electric dipoles. Electric dipoles set up an electric field (Ec) that will propagate through a medium as waves, e.g. radio waves. While the electric field as disclosed by the invention is created around an electrically charged particle, i.e. the electric dipole, the magnetic field used for the wireless link in prior art is created around the coil involved by the modulated magnetic field. Although the electric and magnetic fields are interrelated as known from Maxwell's equations, efficiency of the wireless link can be significantly improved by using the E-field for communication. However, to take advantage of the properties of the E-field, at least the sender antenna has to be an electric dipole, as discussed later in the document.

A further advantage of the invention is that the requirements for alignment and proximity between the sender and receiver pair of couplers are less strict than for prior art inductive couplers.

According to prior art, alignment of the wellbore completion inside a casing of a wellbore requires specific procedures for spacing out the completion so that the downhole magnetic dipoles are properly aligned to establish wireless connectivity, as the wellbore completion is set and the tubing hanger is landed inside the wellhead housing of the well. Magnetic dipoles have to be aligned so that the B-field from a sender can penetrate the coil of the receiver. It is well known that the strength of the B-field around a magnetic dipole has a certain propagation, and that the field is strongest in specific directions relative the coil.

Space out can be understood as the process required to add exactly the necessary tubings to the top of the wellbore completion as this is lowered into the wellbore casing. At the end of the wellbore completion program the wellbore completion is landed and terminated in a tubing hanger in a wellhead housing. If the wellbore completion is to long the tubing has to be lifted up to remove some of the tubing. If it is to short, more tubing has to be added.

If however, the present invention is used, the completion program may be simplified since the alignment is less critical, which in turn can reduce the time both for planning and conducting the wellbore completion program.

Another advantage of the invention is that the pair of electric dipoles according to the invention can be placed a longer distance away from each other than for magnetic dipoles according to prior art.

A further advantage is that the electric dipoles can communicate even when there are intermediate obstacles, as long as they are in the same annulus.

In a number of wellbore applications, such as for e.g. establishing communication between a mother wellbore and lateral wellbores, this adds a lot of flexibility. A sender can be arranged attached or integrated to the tubing wall of the completion, and a receiver may be attached to the tubing wall of the lateral bore. Even when they are not directly opposite each other, or there are obstacles between them, such as edges of the casing where the lateral bore branches off, the sender and receiver pair will be able to establish a reliable wireless power and communication link.

Another application where the use of the invention is advantageous, is to set up communication between sender and receiver pairs at different depths along the motherbore or a lateral bore. This can be important if measurements have to be performed at different locations, such as formation measurements at two levels.

BRIEF DESCRIPTION OF THE DRAWINGS

The attached figures illustrate some embodiments of the claimed invention.

DETAILED DESCRIPTION

The invention will in the following be described and embodiments of the invention will be explained with reference to the accompanying drawings.

Figure 1:
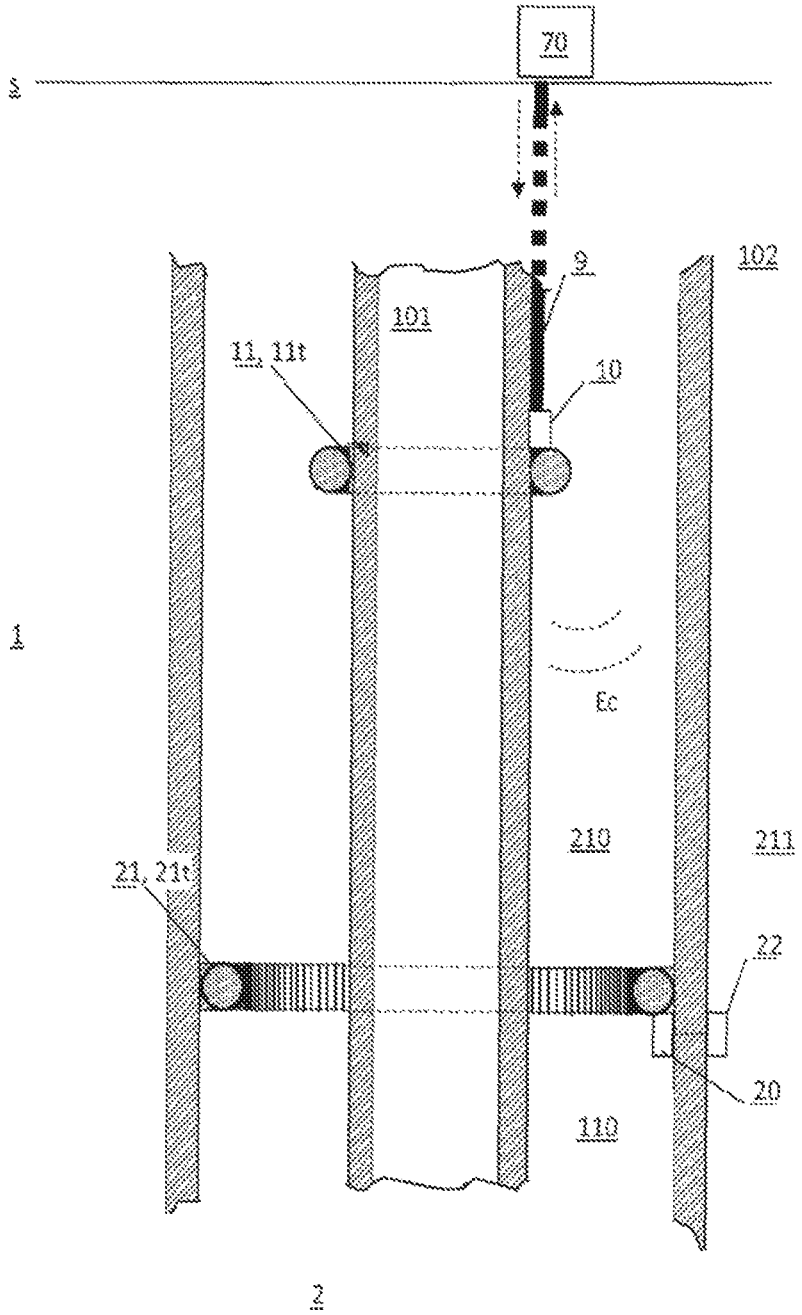
FIG. 1 illustrates in a sectional view a wireless electric transfer system according to an embodiment of the invention with toroidal inductor antennas arranged in an annulus of a wellbore.

FIG. 1 illustrates in a simplified cross sectional drawing an embodiment of the wellbore E-filed wireless communication system (1). The wellbore (2) comprises an inner tool, tubing, liner or casing (101) and an outer tubing, liner or casing (102). In between the inner tool, tubing, liner or casing (101) and an outer tubing, liner or casing (102) there is defined a compartment (210).

It will be understood from the following description of the communication system (1) that it is not important in any of the embodiments whether the compartment, or annulus (210) is delimited by an inner tool, tubing, liner or casing (101) on one side or an outer tubing, liner or casing (102) on the other side, as long as an annulus (210) is defined between the tool, tubing, liner or casing elements. For simplicity, tubing (101) is used to denote inner tool, tubing, liner or casing (101) and casing is used to denote outer tubing, liner or casing (102).

An annulus (210) as described above is typical for modern wellbores and this is where communication according to the invention is typically set up. However, the first and second E-field antennas may be arranged in any compartment of a wellbore, such as in the bore of an open hole formation, or inside the tubing.

In an embodiment the wellbore E-field wireless communication system (1) comprises a wellbore instrument (22) and a second E-field transceiver (20) connected to the wellbore instrument (22) and the second connector of the second antenna (21).

The second E-field transceiver (20) and the wellbore instrument (22) is in this embodiment are separate or integrated remote devices.

In an embodiment the wellbore E-field wireless communication system (1) comprises a control system (70) and a first E-field transceiver (10) connected to the control system (70) and the first connector of the first E-field antenna (11). The control system is typically a surface based system as illustrated in FIG. 1.

The wireless communication system (1) is arranged for transferring a communication signal between the control system (70) and the wellbore instrument (22) via the first and second electric antennas (11, 21) by radio waves (Ec). Radio waves have by definition a frequency between 3 kHz and 300 GHz. In an embodiment the communication signal transferred across the wireless communication system is modulated onto a carrier wave with a radio frequency.

The First and second E-field transmitters (10, 20) are shown in the compartment (210). The first E-field transmitter (10) is connected to one end of a downhole cable (9) arranged to be connected in the other end to -, and communicate with the downhole control system (70). The second E-field transmitter (20) is connected to a wellbore instrument (22) arranged to receive commands from the downhole control system (70) and/or send signals to the downhole control system (70).

The first and second E-field transmitters (10, 20) are connected to first and second antennas (11, 21), respectively, arranged in the same compartment (210). The electric field (Ec) set up between the first and second E-field antennas (11, 21) is illustrated as dotted lines in the figure.

The first E-field transmitter (10) may be connected to either end of the cable (9). In the embodiment where the first E-field transmitter (10) is connected between the cable (9) and the first antenna (11), the cable (9) will typically carry power and information signals down to the downhole E-field transmitter (10) that is responsible for modulating power and information signal onto a carrier.

If the E-field transmitter (10) is arranged on, or close to the surface, the modulation has already been taken care of before propagating downhole, and the cable (9) will be an antenna feeding cable connected directly to the antenna. Typically, a coaxial cable can be used for this purpose. Impedance matching means may also be applied.

The first E-field transmitter may also be arranged anywhere between the two extremities, requiring a portion of the cable to transfer the "raw", unmodulated signals, and a second section to transfer the modulated signal. Different types of cables may therefore be required for the two sections.

Bidirectional communication may be set up by implementing transmitter and receiver pairs into transceivers on both sides of the wireless link, where the same antenna is used for both transmitting and receiving.

The wellbore instrument (22) may be any downhole instrument that requires communication with a downhole control system. An example is a sensor device measuring typical annulus parameters, such as e.g. pressure. It may also be a sensor device for measuring formation parameters outside the casing as illustrated in FIG. 1, where the sensor is communicating with the second E-field transmitter (20) via a communication line through the casing (102).

In an embodiment the wellbore instrument (22) is an actuator for actuating a wellbore component, such as a valve in the wellbore (2).

In an embodiment the downhole cable (9) is arranged to transfer a communication signal from the downhole control system (70) to the first E-field transmitter (10). Further, the first E-field transmitter (10) is arranged to transfer the communication signal to the second E-field transceiver (20) via the first and second antennas (11, 21). In this way a wireless link is established between the end of the downhole cable (9) and the wellbore instrument (22).

In an embodiment the downhole cable (9) is arranged to transfer power from the downhole control system (70) to the first E-field transmitter (10). Further, the first E-field transmitter (10) is arranged to transfer electric power to the second E-field transceiver (20) via the first and second antennas (11, 21). In this embodiment the second E-field transceiver (20) is arranged for power harvesting of the E-field picked up by the second antenna (21) and for distributing electric power to local electric components and circuits. Standard power circuit components may be used for power harvesting and power stabilizing before distributing the power to other components.

The transfer of electric power and communication signals may be performed simultaneously.

In a configuration the frequency of the E-field determined by the size of the antenna and the characteristics of the first and second transceivers (10,20) where electric power is harvested directly from the E-field, while the communication signal is modulated on top of the E-field. The communication signal may be amplitude or frequency modulated.

In an embodiment a digital communication signal is converted to a frequency modulated signal where the bandwidth is different for a digital "0" and a digital "1". On the receiver side the bandwidth can be continuously measured to demodulate the signal back to the original digital signal. Further any known transmission protocol may be applied to this wireless link, such as e.g. error correction.

Due to the frequency characteristics of the E-field, a much higher bandwidth is possible with the system according to the invention than for prior art downhole communication systems. This means that more information can be transferred between the wellbore instrument (22) and the downhole control system (70).

As described previously, wireless power may be supplied to the second transceiver (20). The second transceiver (20) may contain local electronic circuits both for processing signals from the wellbore instrument (22), and for calculating a signal to the wellbore instrument. If the wellbore instrument (22) is a sensor device, the second transceiver (20) may contain signal processing circuits for processing raw sensor data and communicating the processed data from the second transceiver (20) to the first transceiver (10). If the wellbore instrument (20) is an actuator device, the second transceiver (20) may contain signal processing circuits for converting an incoming command to an actuator signal by e.g. triggering a high current switch supplied with power from the harvested power of the second transceiver (20). The second transceiver may also comprise power storage means such as capacitors or batteries to store energy for being able to provide sufficient current for actuation, or as a local back up.

The wellbore instrument (22) may also be a combination of sensor and actuator means, where e.g. actuation is performed based on sensor signal values. In this case the second transceiver (20) or the wellbore instrument (22) may comprise electronic circuits for processing sensor signal values and comparing them with threshold values before operating the actuator.

The invention further comprises inventive features related to the establishment of wireless communication by using the E-field between the first and second antennas (11, 21).

Figure 5:
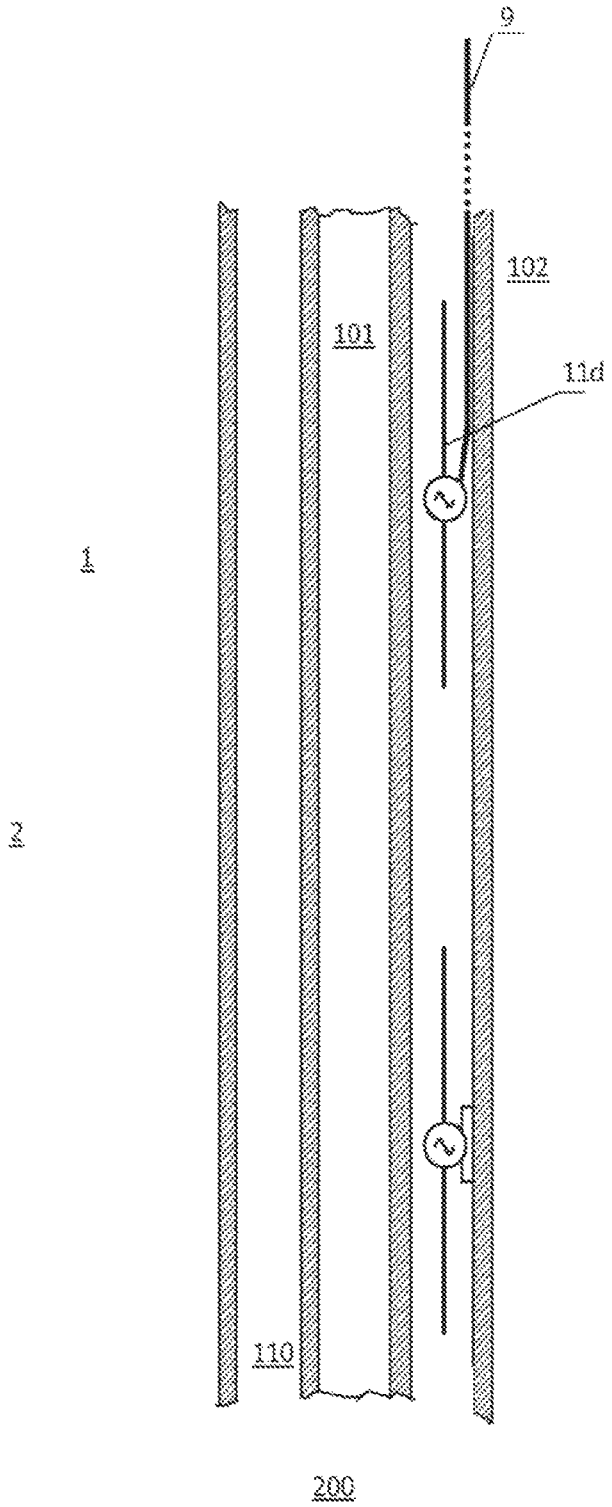
FIG. 5 illustrates in a simplified sectional view a wireless electric transfer system according to an embodiment of the invention with dipole antennas arranged in an annulus of a wellbore.

In an embodiment the first antenna (11) comprises a first dipole antenna (11*d*) as illustrated in FIG. 5. In this case the first dipole antenna is may work as a two way feeding antenna, i.e. power transfer and transfer of communication signals. The first dipole antenna (11*d*) may be directly connected to a downhole cable (9) connected to a downhole control system (70) with a first transceiver (10) close to the downhole control system (70), or the first transceiver (10) may be arranged between the cable (9) and the dipole antenna (11*d*) in the wellbore (2).

Figure 6:
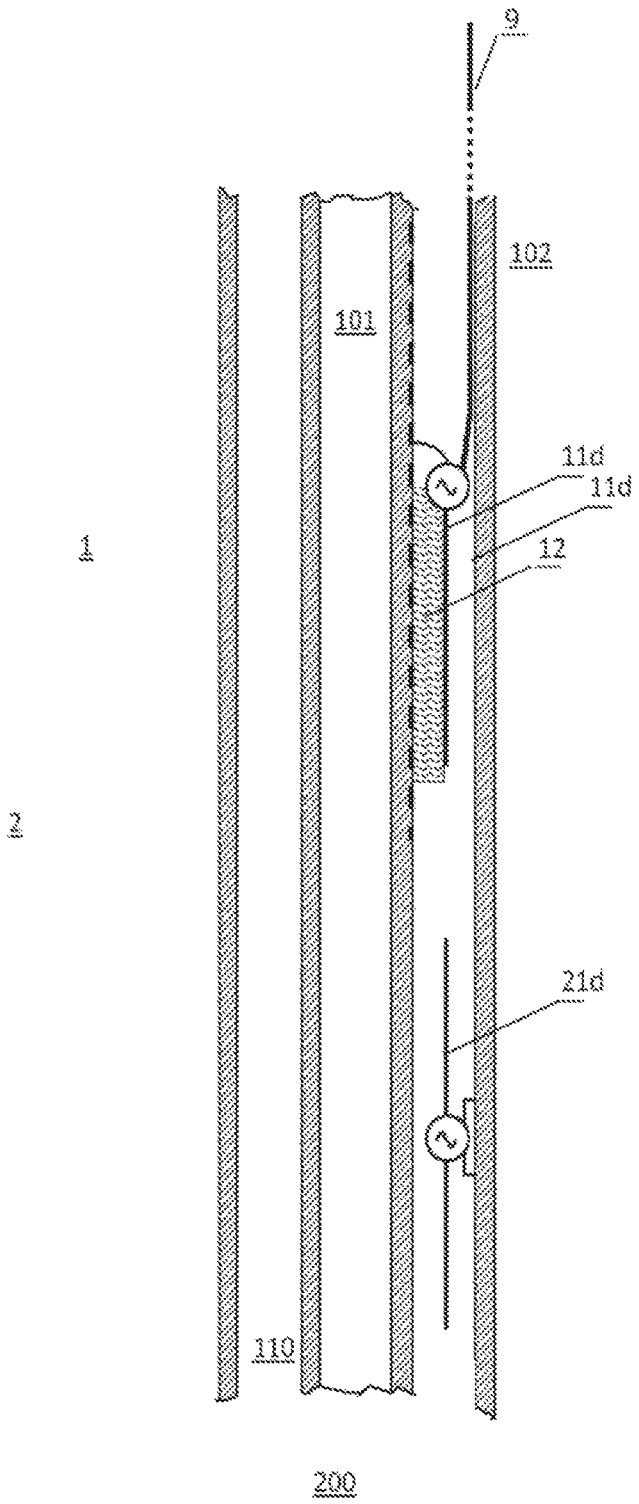
FIG. 6 illustrates the same as in FIG. 5, where the tubing is used as an active element of the dipole antenna.

In an embodiment of the invention one leg of the dipole antenna (11*d*) is the tubing, liner or casing (101) as illustrated in FIG. 6, such that the tubing, liner or casing (101) is an active element of the dipole antenna. A layer of dielectric insulation (12) is also shown to isolate the two legs of the antenna from each other to provide optimum impedance for the antenna.

Another type of antenna that can be used is a toroidal inductor. In an embodiment the first antenna (11) is a toroidal inductor as can be seen on FIG. 1. A toroidal antenna has the effect that the net current inside the major radius of the toroid is zero, which means that the magnetic field remains inside the toroid inductor itself, and only an electric field is radiated from the toroid inductor.

As for the dipole antenna, the toroidal inductor (11*t*) may also be directly connected to the downhole cable (9) connected to a downhole control system (70) with a first transceiver (10) close to the downhole control system (70), or the first transceiver (10) may be arranged between the cable (9) and the dipole antenna (11*d*) in the wellbore (2) as illustrated in FIG. 1.

In the embodiment illustrated in this figure the first toroidal inductor (11*t*) is arranged about a tubing, liner or casing (101) of the wellbore (2), such that the tubing, liner or casing (101) is acting as a waveguide for the electric field (Ec).

Figure 3:
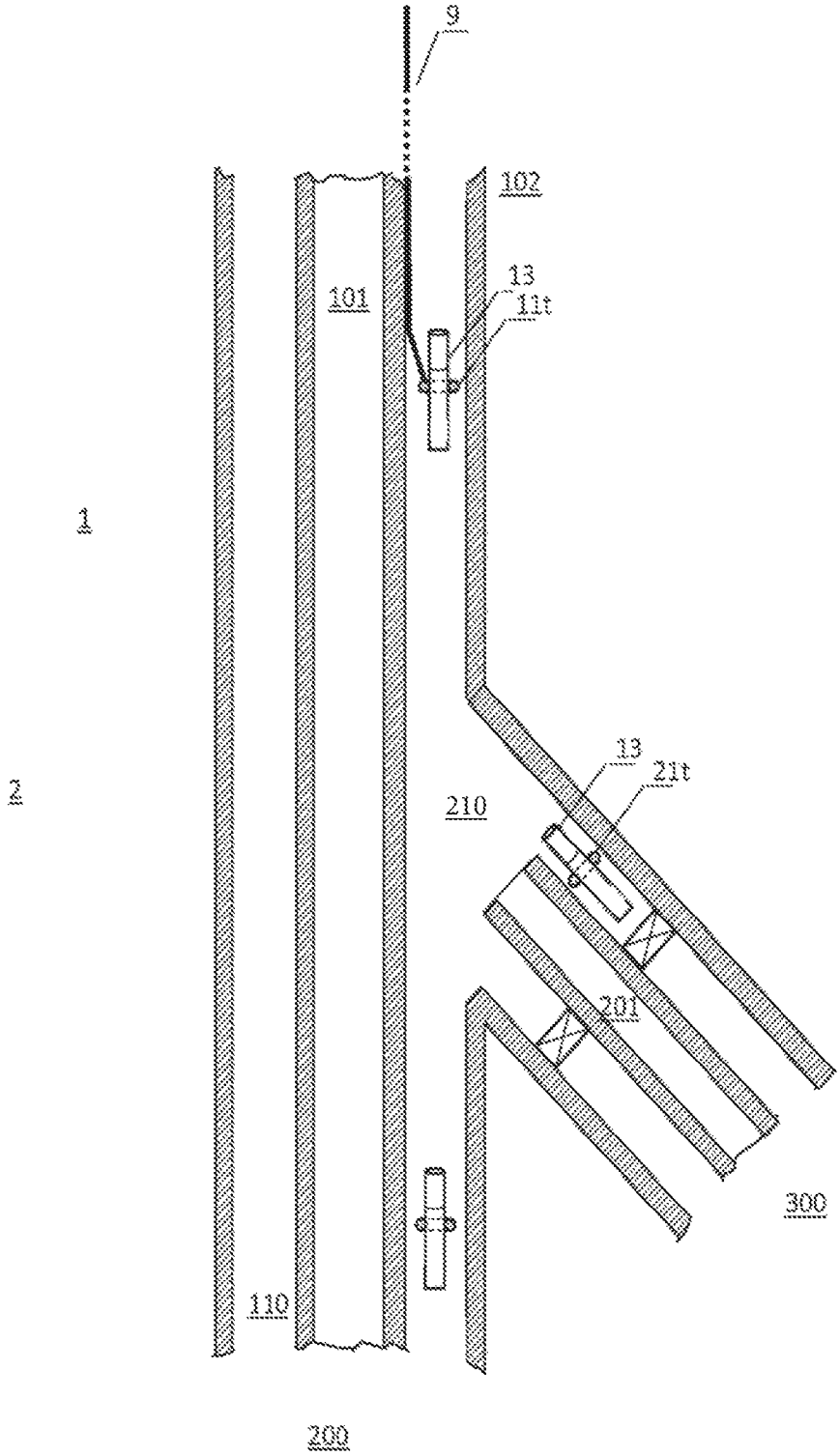
FIG. 3 illustrates in a simplified sectional view toroidal inductor antennas with stand-alone cores arranged in the mother wellbore and a lateral wellbore.

In an embodiment the first toroidal inductor (11*t*) is arranged about a stand-alone metal core (13) within the annulus (210) to as illustrated in FIG. 3. The metal core may be an open tube extending in the direction of the wellbore as illustrated to allow passage of annulus fluid through the inner core of the antenna.

On the opposite side of the wireless transmission system, i.e. close to the wellbore instrument (22) is the second antenna (21). The second antenna (21) may be any dipole antenna or toroidal inductor antenna as described above for the first antenna (11).

Some combinations of first and second antennas (11, 21) will be described below.

Figure 2:
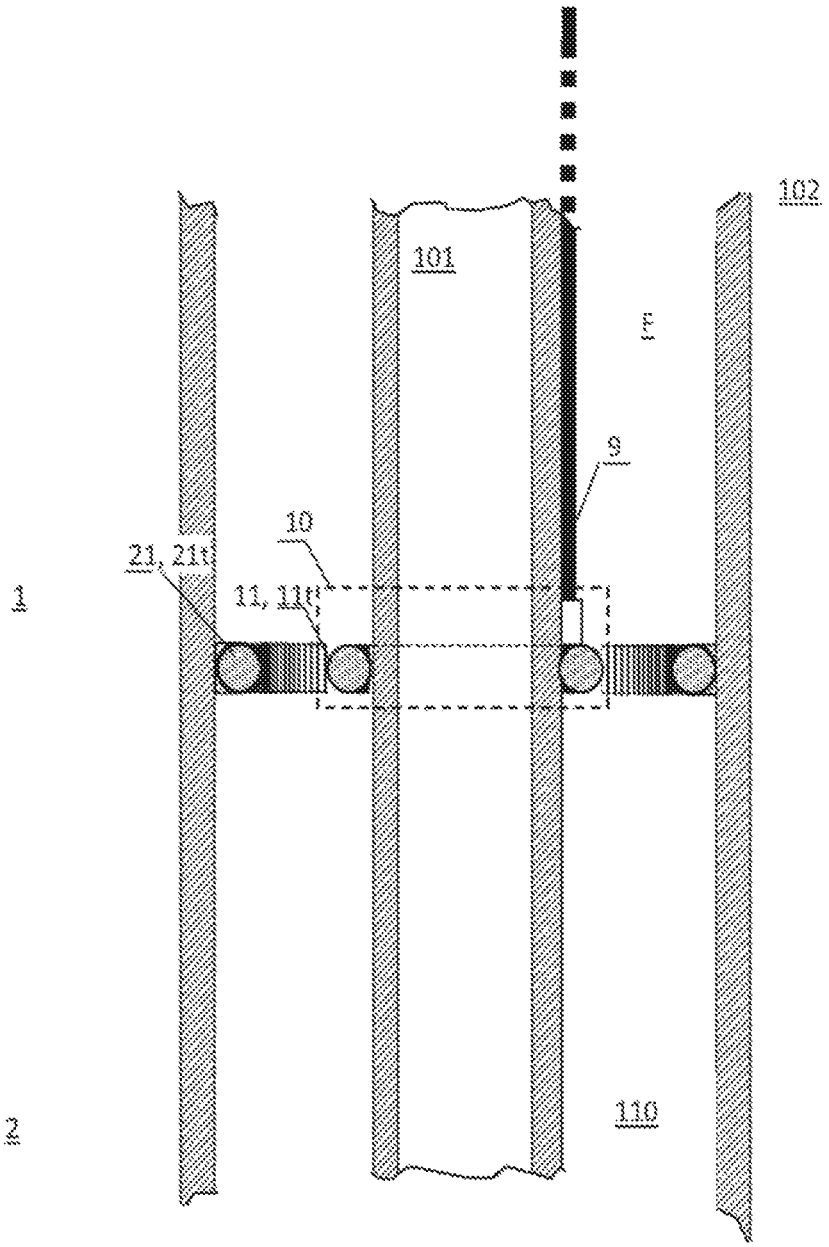
FIG. 2 illustrates in the same way as in FIG. 1 a wireless electric transfer system according to an embodiment of the invention where the toroidal inductor antennas are arranged at the same height.

In FIG. 1 and FIG. 2 the first and second antennas (11, 12) are toroidal inductor antennas (11*t*, 12*t*) about a tubing, liner or casing (101). In the embodiment where the tubing, liner or casing (101) is metallic, it becomes a waveguide able to transfer signals between the first and second antennas (11*t*, 12*t*). FIG. 2 illustrates the special case where the two antennas are arranged at the same height.

In FIG. 3*a* the second antenna is similar to the first antenna described above. I.e. a second toroidal inductor (21*t*) about a stand-alone metal core (13).

FIG. 6 illustrates the use of a simple dipole antenna arranged in the annulus as the second antenna (21). As for the first dipole antenna (11*d*), the second dipole antenna (21*d*) may also have the tubing, casing or liner (102) acting as an active element by connecting one leg to the tubing, casing or liner (102), i.e. the wall to the right of the dipole shown, and insulated the two antenna legs with a dielectric insulation.

The antenna configurations described above may be combined. E.g. in FIGS. 1 and 2 the second antenna may also be a second toroidal inductor (21*t*) about a stand-alone metal core (13) or a dipole antenna. In FIG. 3 the second antenna may be a toroidal inductor (21*t*) about the tubing, casing or liner (101, 102) or a dipole antenna. In FIGS. 5 and 6 the second antenna may be second toroidal inductor (21*t*) about a stand-alone metal core (13) or about the tubing, casing or liner (101, 102).

Figure 7:
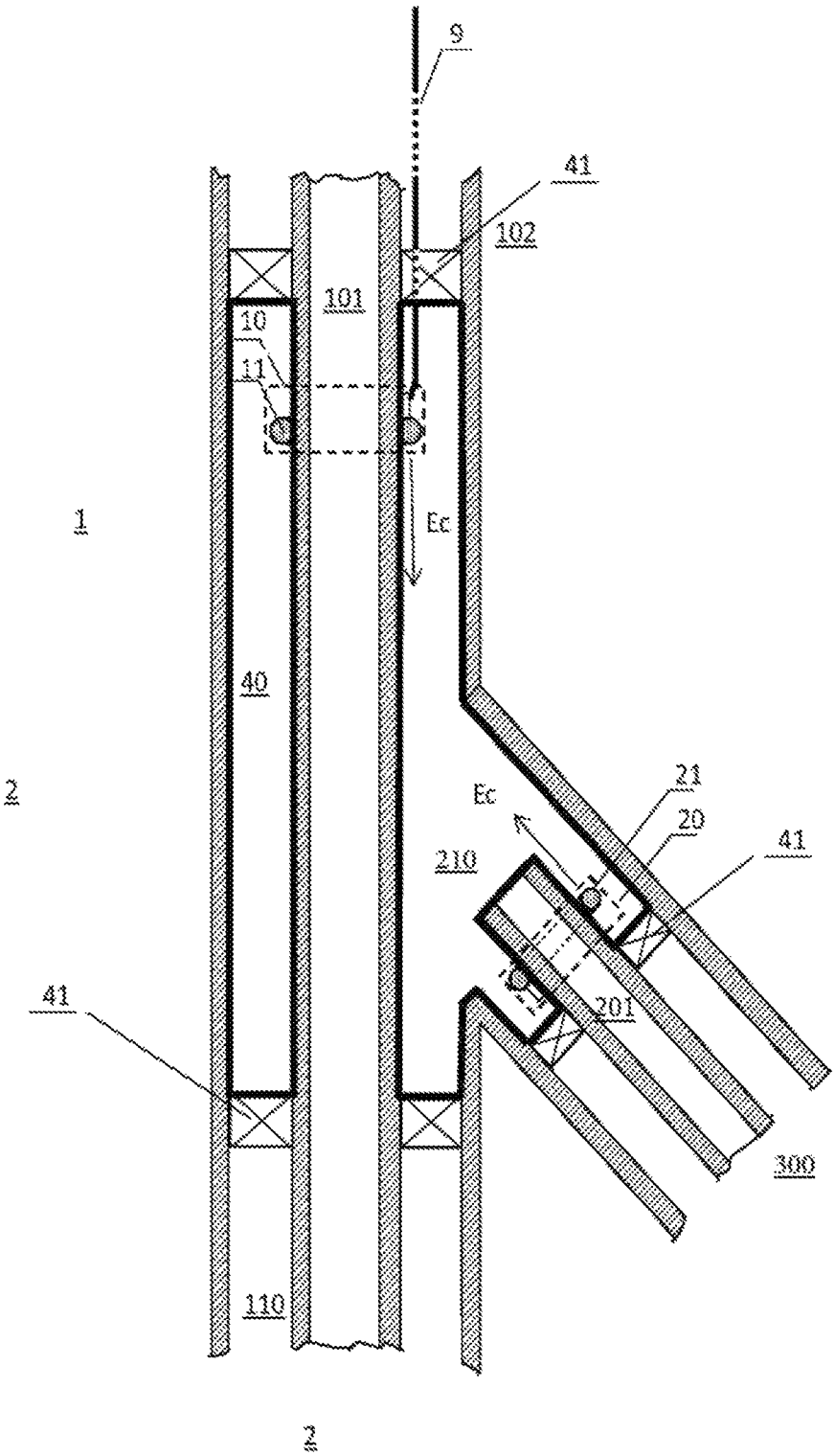
FIG. 7 illustrates in a sectional view a wireless electric transfer system according to an embodiment of the invention comprising a resonator wherein the antennas are arranged.

According to an embodiment the wellbore E-field wireless communication system (1), comprises a metallic resonator (40) surrounding the first antenna (11) and the second antenna (21) as illustrated with the thicker line in FIG. 7. The metallic resonator may be tuned to the frequency of the E-field to enable more efficient transfer of both power and communication signals. The first and second antennas (11, 21) inside the resonator may be a combination of any of the types described above.

In one embodiment the resonator (40) comprises one or more metallic packers (41) arranged to delimit the size of the annulus (210).

Figure 4:
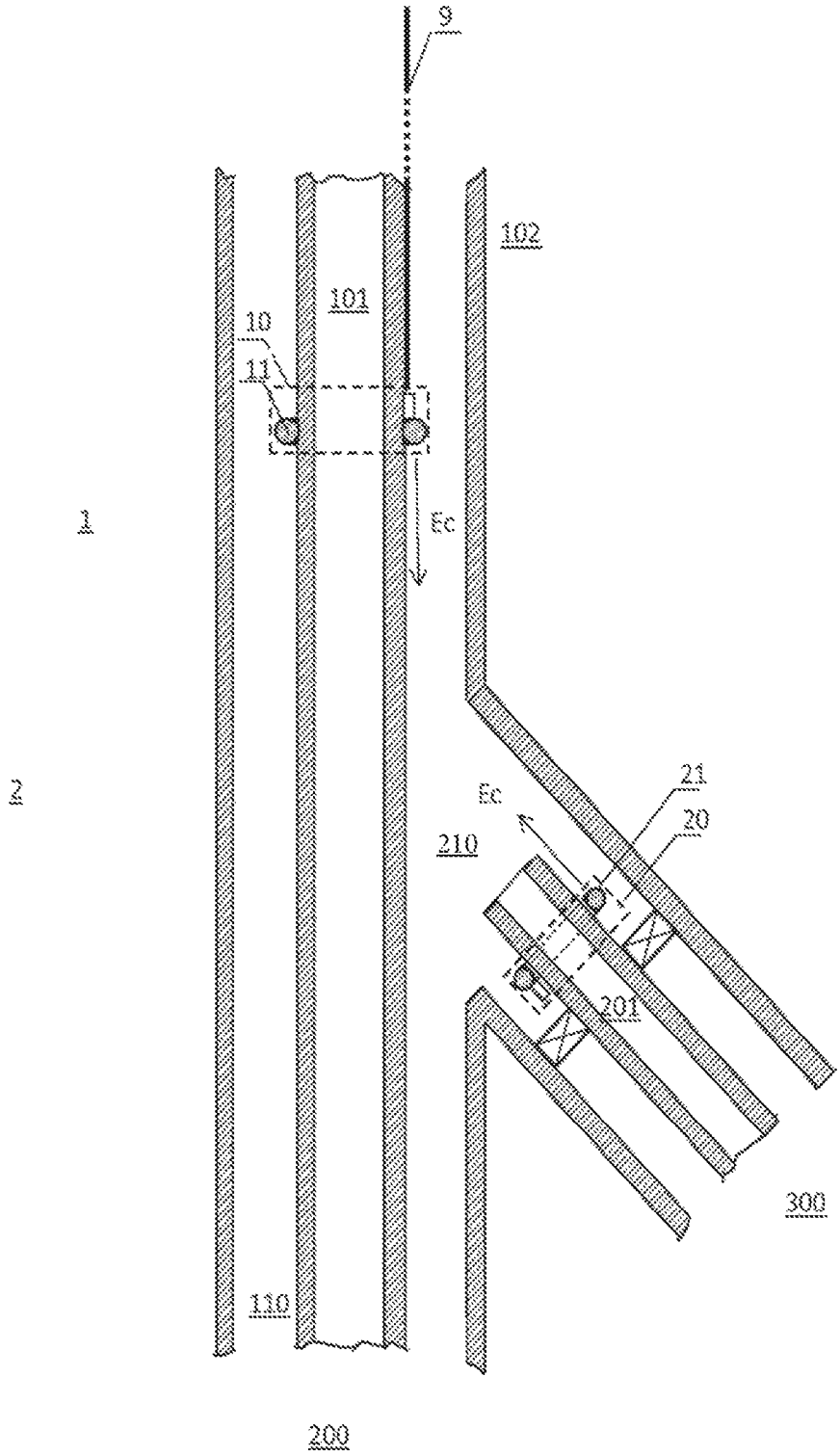
FIG. 4 illustrates the same as in FIG. 3, where the antennas are toroidal inductor antennas arranged about a motherbore tubing (101) and a lateral tubing (201).

According to an embodiment of the invention, the second antenna (21) is arranged in a lateral wellbore (300) as illustrated in FIGS. 3, 4 and 7, to enable wireless connectivity with a second antenna (21) arranged in the same annulus (210) as the first antenna (11) and connected to a wellbore instrument (22).

Communication between the first antenna and two or more second antennas arranged in different lateral wellbores in a multi-lateral well may be set up in the same way. A multiplexing scheme or any other suitable protocol for network communication can be used for communicating with the different lateral wellbores.

Figure 8:
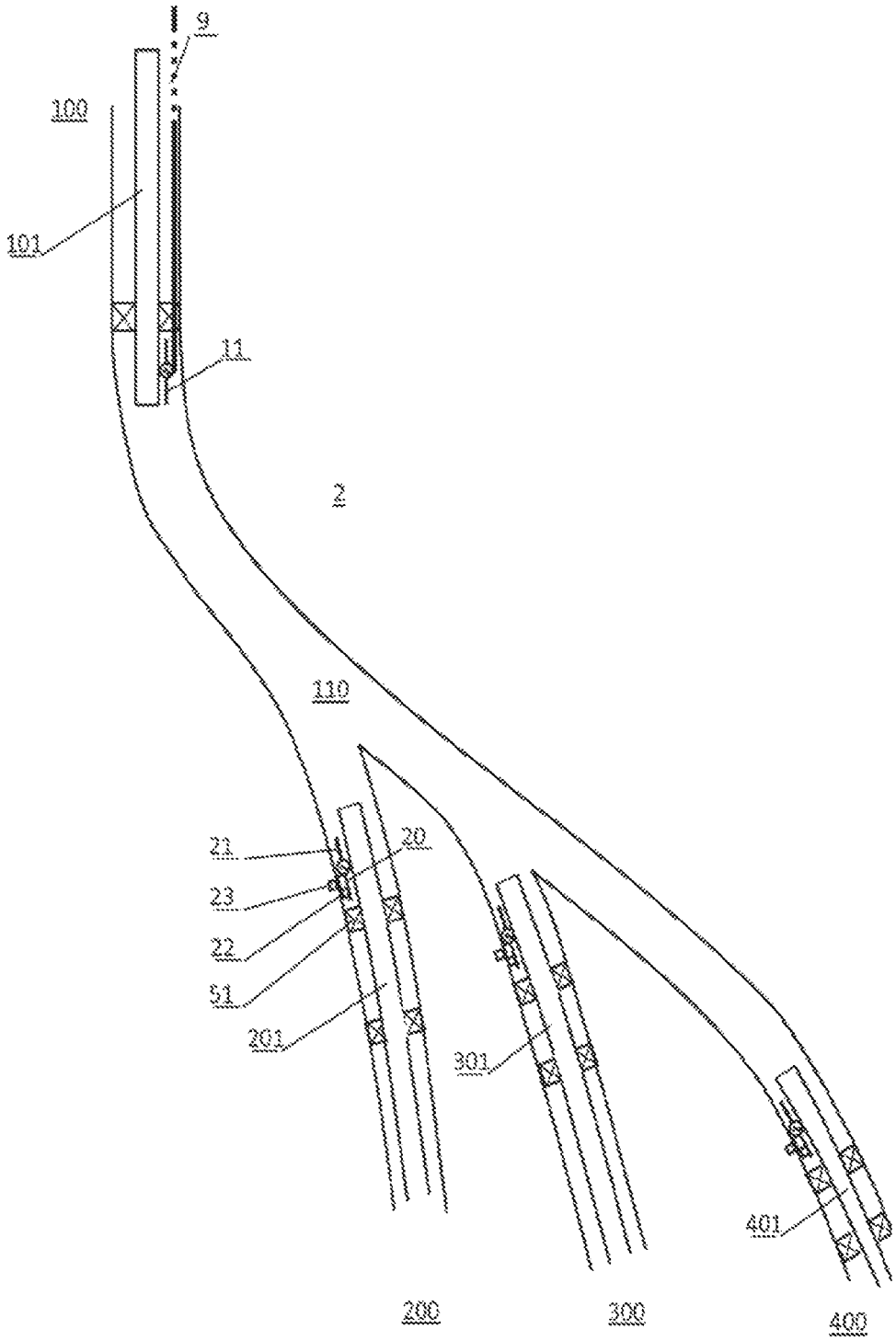
FIG. 8 illustrates in a sectional view the system according to the invention in a multi-lateral wellbore (2) with an open hole formation.

FIG. 8 shows a wellbore E-field wireless communication system (1), according to an embodiment of the invention, in a multi-lateral wellbore comprising a main bore (100) and lateral wellbores (200, 300, 400). The first antenna or electric dipole (11) is connected to a surface control system as described previously.

Second antennas, or electric dipoles (21) are arranged in two or more of the lateral wellbores (200, 300, 400), each connected to an E-field transmitter (20) in respective lateral wellbores. In turn, each of the E-field transmitters are connected to a wellbore instrument (22). It is also shown a second wellbore instrument (23) arranged in the wellbore formation of the wellbore and connected to the E-field transmitter (20). In an embodiment the first wellbore instruments (22) are pressure sensors, measuring a pressure in the lateral wellbore, and the second wellbore instruments (23) are sensors used to measure formation parameters. However, the E-field wireless communication system (1), may be used in any application and for the wireless transfer of any information from any sensor or actuator within a compartment of a wellbore.

FIG. 8 illustrates a multi-lateral well with an open hole formation, but it can be used in the same way in a wellbore with casings or liners, where the compartment then becomes an annulus of the wellbore.

FIGS. 1 to 8 above are drafted to illustrate different embodiments of the invention. A number of common elements of a wellbore such as packers, valves, lateral branching devices etc. are left out as will be understood by a person skilled in the art.

Calculations for the comparison of the use of magnetic coil antennas or toroidal inductors and electric dipoles as transmitter antennas have been elaborated and the results are summarized below. They show that using a coil antenna, i.e. magnetic dipole as a transmitter antenna is normally not as good as using an electric dipole as a transmitter antenna, in terms of efficiency and the impedance matching.

The power transferring between two antennas can be considered as two procedures.

(a) A transmitter antenna generates electromagnetic fields in the space. The fields generated are proportional to IL, where I is the current on the Tx antenna, and L is the equivalent length of the antenna.

(b) The receiver antenna picks the fields in the space and generates a voltage in the receiver circuit. The received voltage is proportional to the antenna equivalent length L of the antenna.

Therefore it is important to investigate the equivalent lengths of the electric dipole and the coil antenna.

The equivalent length of a coil antenna is:

$$l=kS \tag{1}$$

where l is the equivalent antenna length of the coil antenna. For the dipole case, the equivalent antenna length is the physical length of the antenna.

k is the wave number and $k=2\pi/\lambda$ ($\lambda$: wave length)

S is coil effective area, and $$S=N\mu_{core}\pi\alpha^2 \quad (2)$$

where N is the number of turns and a is the radius of the coil, and μcore is the relative permeability the core material.

Since at low frequency k is a small number, equation (2) means that the coil antenna has low radiation efficiency.

Equation (1) shows that the equivalent antenna length of a coil is a function of the wave length and thus a function of frequency. The following table shows the number of turns needed for a coil with diameter 4 cm (air core) to reach an equivalent length 1 m for frequency 100 kHz, 1 MHz, 10 MHz and 2 MHz, for μcore=1.

TABLE 1

| Number of turns for a coil having 1 m equivalent length | | | | |
|---|---|---|---|---|
| frequency | 100 kHz | 1 MHz | 10 MHz | 100 MHz |
| N | 380000 | 38000 | 3800 | 380 |

From the table we can see that many turns are needed to realize an equivalent length 1 m at low frequencies.

One may increase the coil effective area shown in (2) by introducing a ferrite core. However, the saturation of the core stops using high current. That is why coils are less applicable as transmitter antennas.

Here we should comment that for power delivering for the case with steel casing, one need to generate magnetic field along the casing direction. For that application, the coil antenna may be advantageously used as a Tx antenna.

For a Tx antenna, it is important to have proper impedance match at the input port for increasing the power delivering efficiency. The input impedance of an electric dipole is its radiation impedance, which is resistive about 60 Ohm for a quarter wavelength antenna. However, the input impedance of a coil antenna is the sum of its radiation impedance and the inductance of the coil, which is dominated by the inductance part. Hence it is more difficult to make impedance match for the coil antenna than for the electric dipole case.

For the receiver antenna, the current is weak. One can use many turns on a ferrite core without saturation. In addition, the impedance matching for the receiver antenna is not as important as for the Tx antenna. So the coil antenna can be used as a receiver antenna.

For power delivering without steel casing, using an electric dipole is better than using a coil antenna as a Tx antenna. However, the receiver antenna can use either the electric dipole or coil antenna.

While the foregoing is directed to embodiments of the present invention, other and further embodiments of the invention may be devised without departing from the basic scope thereof, and the scope thereof is determined by the claims that follow.

The invention claimed is:

1. A wellbore wireless communication system, said communication system comprising:

a first E-field antenna; and a second E-field antenna;

wherein said first antenna, and said second antenna are both arranged in a common compartment of a wellbore and further arranged for transferring a signal between said first E-field antenna and said second E-field antenna;

wherein said first E-field antenna comprises a first dipole antenna;

wherein one leg of said first dipole antenna is a tubing, liner or casing of said wellbore, and said system further comprises a layer of dielectric insulation between said first leg and a second leg of said first dipole antenna, such that said tubing, liner or casing is an active element of said dipole antenna.

2. A wellbore wireless communication system according to claim 1, comprising:

a control system;

a wellbore instrument;

a first E-field transceiver connected to said control system and said first E-field antenna;

a second E-field transceiver connected to said wellbore instrument and said second antenna;

wherein said wireless communication system is arranged for transferring a communication signal between said control system and said wellbore instrument via said first and second E-field antennas.

3. A wellbore wireless communication system according to claim 2, comprising:

a wellbore cable between said control system and said first E-field transceiver.

4. A wellbore wireless communication system according to claim 1, wherein said second antenna comprises a second dipole antenna.

5. A wellbore wireless communication system according to claim 4, wherein said second antenna is arranged in a lateral wellbore.

6. A wellbore wireless communication system according to claim 1, wherein said second E-field antenna comprises a first toroidal inductor.

7. A wellbore wireless communication system according to claim 1, wherein said system comprises a metallic resonator surrounding said first antenna and said second antenna.

8. A wellbore wireless communication system according to claim 7, wherein the resonator extends into a lateral wellbore.

9. A wellbore wireless communication system, said communication system comprising:

a first E-field antenna; and a second E-field antenna;

wherein said first antenna, and said second antenna are both arranged in a common compartment of a wellbore and further arranged for transferring a signal between said first E-field antenna and said second E-field antenna;

wherein said system comprises a metallic resonator surrounding said first antenna and said second antenna;

wherein the resonator comprises a metallic packer arranged to delimit the size of the compartment.

10. A wellbore wireless communication system according to claim 9, wherein the resonator extends into a lateral wellbore.

* * * * *